US011235595B2

(12) United States Patent
Tanaka

(10) Patent No.: US 11,235,595 B2
(45) Date of Patent: Feb. 1, 2022

(54) PRINTING APPARATUS

(71) Applicant: BROTHER KOGYO KABUSHIKI KAISHA, Nagoya (JP)

(72) Inventor: Mitsugi Tanaka, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/104,791

(22) Filed: Nov. 25, 2020

(65) Prior Publication Data

US 2021/0178782 A1 Jun. 17, 2021

(30) Foreign Application Priority Data

Dec. 16, 2019 (JP) ..... JP2019-226847

(51) Int. Cl.
*B41J 29/02* (2006.01)
*B41J 11/00* (2006.01)
*B41J 15/04* (2006.01)

(52) U.S. Cl.
CPC ..... *B41J 11/0045* (2013.01); *B41J 15/042* (2013.01); *B41J 29/02* (2013.01)

(58) Field of Classification Search
CPC ..... B41J 11/0045; B41J 29/02; B41J 15/042; B41J 11/007; B41J 15/046
See application file for complete search history.

(56) References Cited

U.S. PATENT DOCUMENTS 9,227,445 B2 * 1/2016 Murata ..... B41J 29/02
2005/0232679 A1 * 10/2005 Na ..... B41J 11/04 400/649
2015/0165801 A1 6/2015 Murata et al.

FOREIGN PATENT DOCUMENTS

JP 2015-112837 A 6/2015

* cited by examiner

*Primary Examiner* — Huan H Tran
(74) *Attorney, Agent, or Firm* — Scully, Scott, Murphy & Presser, PC

(57) ABSTRACT

A printing apparatus includes: a sheet storing part configured to store a sheet; a conveying mechanism configured to convey the sheet taken out from the sheet storing part; a first frame and a second frame arranged in an opposing direction with the conveying mechanism interposed therebetween; a printing part configured to perform printing on the sheet conveyed by the conveying mechanism; a cover composing at least a part of an upstream side, of the printing apparatus, with respect to the printing part in a conveyance direction in which the sheet is conveyed by the conveying mechanism; and a rotational shaft extending in the opposing direction and configured to support the cover to be rotatable. The rotational shaft has a first end and a second end in the opposing direction, and the first end is supported by the first frame and the second end is separated away from the second frame.

9 Claims, 8 Drawing Sheets

PRINTING APPARATUS

CROSS REFERENCE TO RELATED APPLICATION

The present application claims priority from Japanese Patent Application No. 2019-226847, filed on Dec. 16, 2019, the disclosure of which is incorporated herein by reference in its entirety.

BACKGROUND

Field of the Invention

The present disclosure relates to a printing apparatus which performs printing on a printing object.

Description of the Related Art

There is a known printing apparatus in which a roll sheet (sheet roll, roll of sheet) as a print object (object for which printing is to be performed) is stored in a main body of the printing apparatus, and the sheet is conveyed to a printing part and printing is performed for the roll sheet. In such a printing apparatus, in a case that printing is to be started, it is necessary that a cover provided on an upper part of the main body is opened and that an end of the roll sheet is installed in a predetermined position in a conveying mechanism. The cover rotates (pivots) about a shaft (axis) along a conveyance direction of the sheet.

SUMMARY

However, in a case that a cover which is rotatable about a shaft which is along a direction orthogonal to the conveyance direction of the sheet, and that both ends of the rotational shaft are rotatably supported by two frames arranged with the conveying mechanism interposed therebetween, there are the following problems. That is, in a case that a user installs the roll sheet in an accommodating part and then draws or takes out a forward end of the sheet to thereby install (arrange) the forward end in the conveying mechanism, the user must insert the forward end of the roll sheet into an area of which four sides are surrounded by the conveying mechanism, the two frames, and the rotational shaft. Therefore, the workability (working efficiency) is lowered. Further, there is such a problem that after the printing, the roll cannot be replaced until the roll is rewound so that the forward end of the roll passes through the area of which four sides are surrounded.

An object of the present disclosure is to realize a printing apparatus capable of improving the workability in a case that an end of a sheet is installed in a conveying mechanism.

According to an aspect of the present disclosure, there is provided a printing apparatus including: a sheet storing part configured to store a sheet therein; a conveying mechanism configured to convey the sheet taken out from the sheet storing part; a first frame and a second frame arranged in a opposing direction with the conveying mechanism interposed therebetween; a printing part configured to perform printing on the sheet conveyed by the conveying mechanism; a cover composing at least a part, of the printing apparatus, on an upstream side in a conveyance direction in which the sheet is conveyed by the conveying mechanism; and a rotational shaft extending in the opposing direction and configured to support the cover to be rotatable, wherein the rotational shaft has a first end and a second end in the opposing direction, and the first end is supported by the first frame, and the second end is separated away from the second frame.

According to the aspect of the present disclosure, it is possible to improve the workability in a case that an end of the sheet is installed in the conveying mechanism.

DESCRIPTION OF THE EMBODIMENTS

First Embodiment

Figure 1:
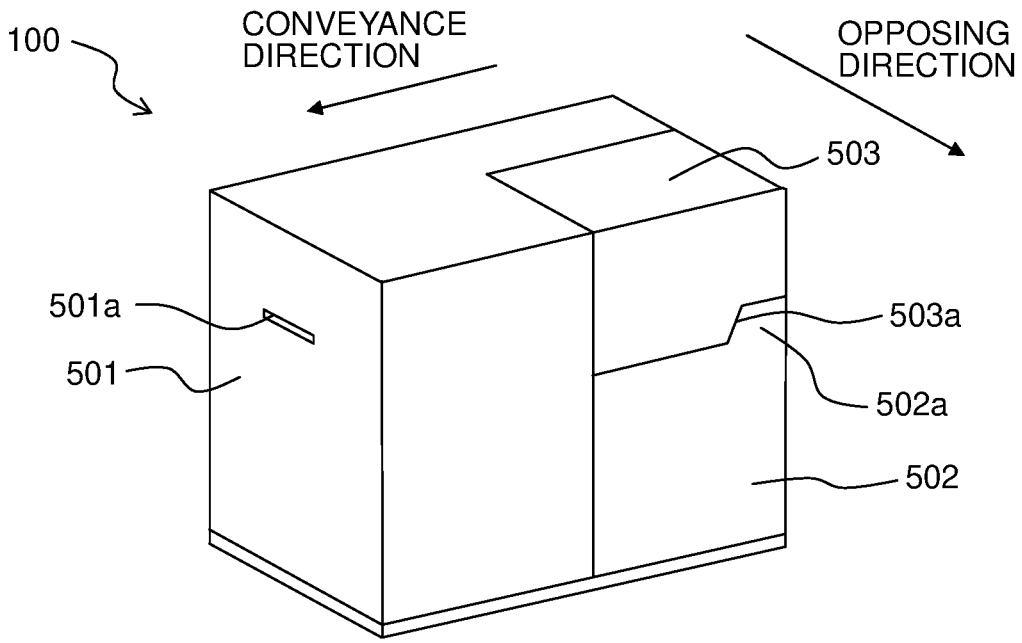
FIG. 1 is a perspective view of a printing apparatus according to a first embodiment of the present disclosure.

A first embodiment of the present disclosure will be described below, with reference to FIGS. 1 to 6. Note that in FIG. 2, a rear surface of a case 501 and a door 502 are omitted in the illustration. Further, in FIG. 4, the case 501, the door 502 and a cover case 600 are omitted in the illustration.

The printing apparatus 100 is an ink-jet label printer. As depicted in FIGS. 1 to 4, the printing apparatus 100 includes a cover 503, a first frame 401, a second frame 402, a conveying mechanism 6, a head 7 as an example of a printing part, a rotational shaft 3, a sheet storing part 50, a roll paper holder 5, the case 501 and the door 502.

As depicted in FIG. 1, outer surfaces of the printing apparatus 100 are composed by the case 501, the door 502 and the cover 503. The door 502 is movable in a conveyance direction in which a roll paper 51 (to be described later on) is conveyed, and normally composes a part of a left side surface of the printing apparatus 100 as seen from the conveyance direction. In a case that the cover 503 is in a closed state, the cover 503 composes a part of the left side surface, a part of an upper surface, and a part of a rear surface of the printing apparatus 100 (i.e., an upstream side, of the printing apparatus 100, with respect to the head 7 in the conveyance direction). The case 501 composes a part, of the outer surfaces of the printing apparatus 100, which is not composed by the door 502 and the cover 503. A paper discharge port 501*a* via which the roll paper 51 having printing performed thereon is discharged is formed in the case 501.

Figure 4:
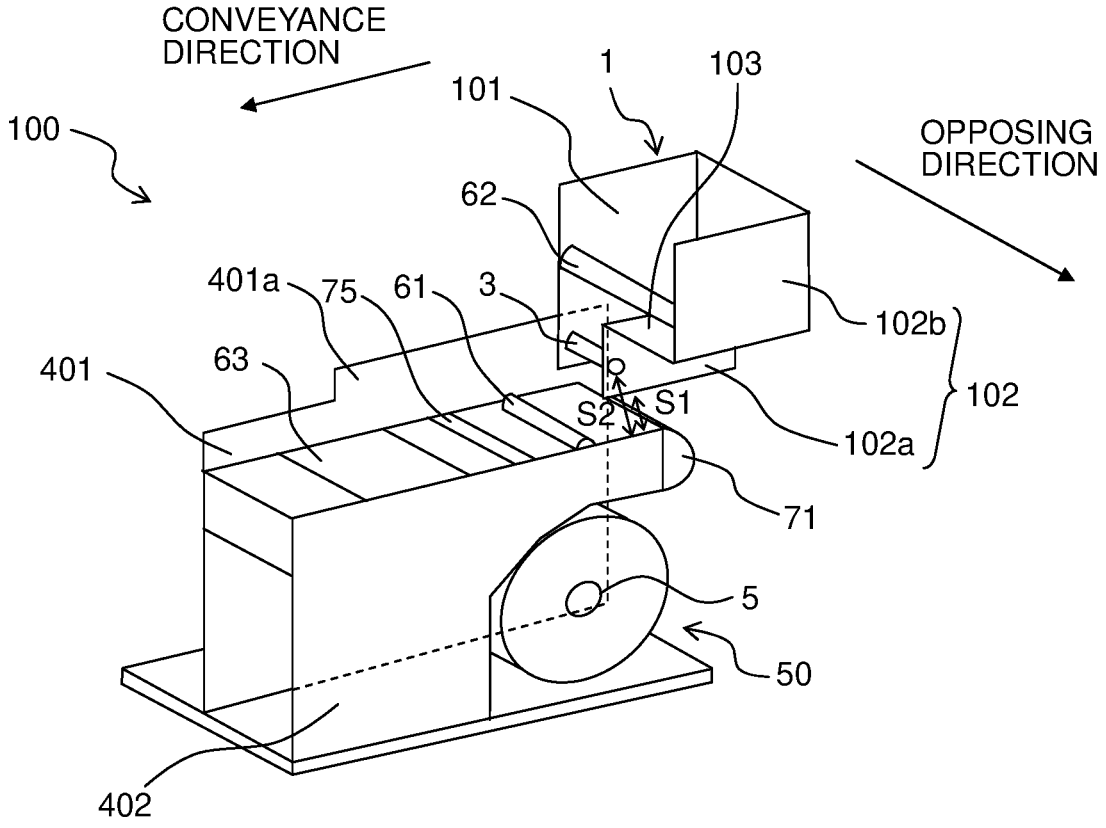
FIG. 4 is a perspective view depicting the configuration for rotatably supporting a rotational shaft provided on the printing apparatus.

As depicted in FIG. 4, in the printing apparatus 100, the first frame 401 and the second frame 402 made of surfaces, respectively, extending in the up-down direction are installed so as to face each other. A conveying mechanism 6, a seat storing part 50, and a head 7 (which will be described later on) are provided between the first frame 401 and the second frame 402. In the second frame 402, a cutout (notch) is formed in an area in which the sheet storing part 50 is installed. A rising part (upright part) 401*a* configured to support the rotational shaft 3 is formed in an upper part of the first frame 401. In the following explanation, a direction in which the first frame 401 and the second frame 402 face each other is referred to as a "opposing direction". Further, in the respective embodiments including the first embodiment, the explanation will be made while assuming that an end part, of the printing apparatus 100, on a downstream side in the conveyance direction is defined as a front surface of the printing apparatus 100, and that the cover 503 is arranged at an upper part of the printing apparatus 100.

Figure 2:
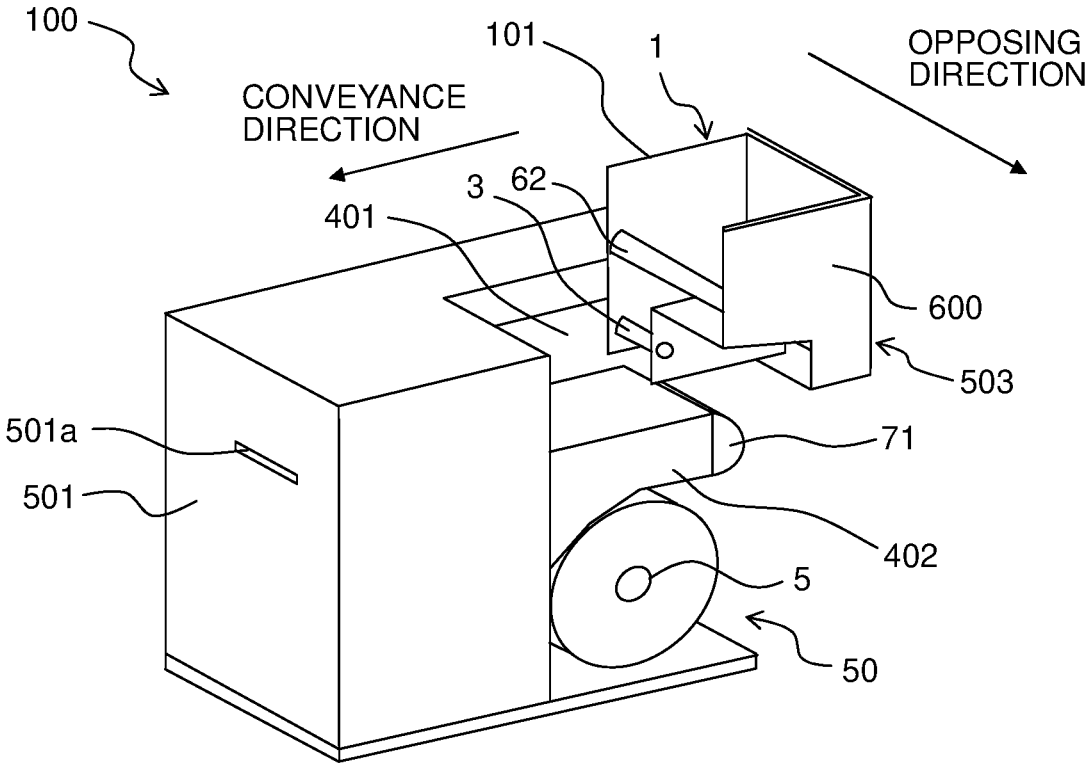
FIG. 2 is a perspective view of the printing apparatus in a state that a cover is opened.
Figure 3:
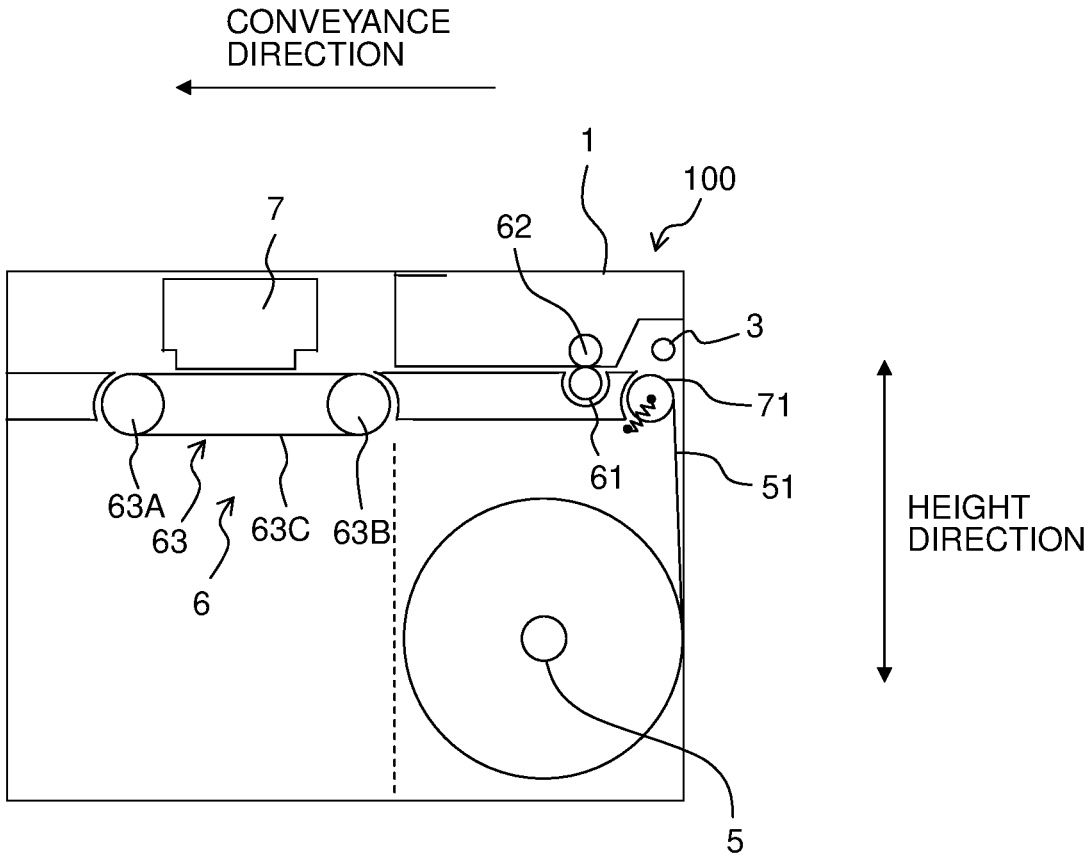
FIG. 3 is a side view depicting the internal structure of the printing apparatus.

As depicted in FIGS. 2 to 4, the sheet storing part 50 is formed in an end part on an upstream side in the conveyance direction of a space between the first frame 401 and the second frame 402, and the roll paper holder 5 is installed in the sheet storing part 50. The roll paper 51 as an example of a "sheet" is wound around the roll paper holder 5; in a case that the roll paper holder 5 is driven to rotate by a motor (not depicted in the drawings), the roll paper 51 is thereby fed out.

The conveying mechanism 6 is a mechanism configured to convey the roll paper 51 in a predetermined conveyance direction, and has a conveying roller 61 as an example of a first roller, a pressing roller 62 as an example of a second roller, and a conveying belt mechanism 63. The conveying mechanism 6 is arranged while being sandwiched between the first frame 401 and the second frame 402 in the opposing direction.

The conveying roller 61 is a roller which conveys the roll paper 51, and is installed on the upstream side, in the conveyance direction of the roller paper 51, with respect to the head 7 (to be described later on). The conveying roller 61 is rotatably supported by the first frame 401 and the second frame 402, and is rotatably driven by a motor (not depicted in the drawings).

The pressing roller 62 makes contact with the conveying roller 61, in a case that the cover 503 is in the closed state, at a predetermined position of an area in which the roll paper 51 is conveyed, and presses the roll paper 51 with respect to the conveying roller 61. The pressing roller 62 is rotatably installed in the cover 503. The conveying roller 61 and the pressing roller 62 construct a roller pair, and rotate while pinching or sandwiching the roll paper 51 therebetween so as to convey the roll paper 51 fed from the roll paper holder 5 in the conveyance direction. Note that in the present embodiment, although the conveying roller is provided so as to be supported by the first frame 401 and the second frame 402, and the pressing roller is provided on the cover 503, the present disclosure is not limited to this. For example, a pressing roller may be provided so as to be supported by the first frame 401 and the second frame 402, and a conveying roller may be provided on the cover 503.

The conveying belt mechanism 63 is a mechanism in which a conveying belt 63C is stretched over a driving belt roller 63A and a driven belt roller 63B. An upper surface of the conveying belt 63C is a conveying surface for conveying the roll paper 51. The conveying belt mechanism 63 is supported by the first frame 401 and the second frame 402.

A large number of a nozzle which discharge a UV-ink as an example of a liquid is formed in a surface, of the head 7, which faces the conveying belt 63C. With such a structure, the head 7 performs printing by ejecting UV ink onto the print surface of the roll paper 51 which is being conveyed on the conveying belt 63C. The head 7 is supported by the first frame 401 and the second frame 402.

As depicted in FIG. 1, the cover 503 covers a part of an upper part of the printing apparatus 100. As depicted in FIG. 2, the cover 503 includes a frame 1, and a cover case 600 covering an outer side of the frame 1. As depicted in FIG. 4, the cover 503 is supported to be rotatable by the rotational shaft 3 rotatably supported by the rising part 401*a* of the first frame 401. The rotational shaft 3 extends in the opposing direction and is provided in the vicinity of the conveying mechanism 6 in a height direction intersecting with the opposing direction and the conveyance direction, as depicted in FIG. 3. The frame 1 and the cover case 600 are fixed to each other; in a case that the cover 503 is pivoted, the frame 1 and the cover case 600 pivot at the same time.

In the frame 1, one end part in the conveyance direction thereof is rotatably supported by the rotational shaft 3, the posture of the frame 1 can be changed to a first posture (open state) in which other end part in the conveyance direction is separated away from the main body and a second posture (closed state) in which the other end part is closer to the first frame 401 and the second frame 402 as compared with the first posture. The frame 1 and the conveying mechanism 6 are arranged side by side in the up-down direction.

Next, the frame 1 and the rotational shaft 3 will be explained in detail. As depicted in FIG. 4, the frame 1 has two side surfaces 101 and 102 facing each other in the opposing direction. The side surface 102 includes a first surface 102*b* and a second surface 102*a*. The second surface 102*a* is positioned between the side surface 101 and the first surface 102*b* in the opposing direction so that a distance from the side surface 101 is same as a length in the opposing direction of the rotational shaft 3; an end of the rotational shaft 3 is supported by the second surface 102*a*. The frame 1 also includes a connecting surface 103 which connects the first surface 102*b* and the second surface 102*a*.

Figure 5:
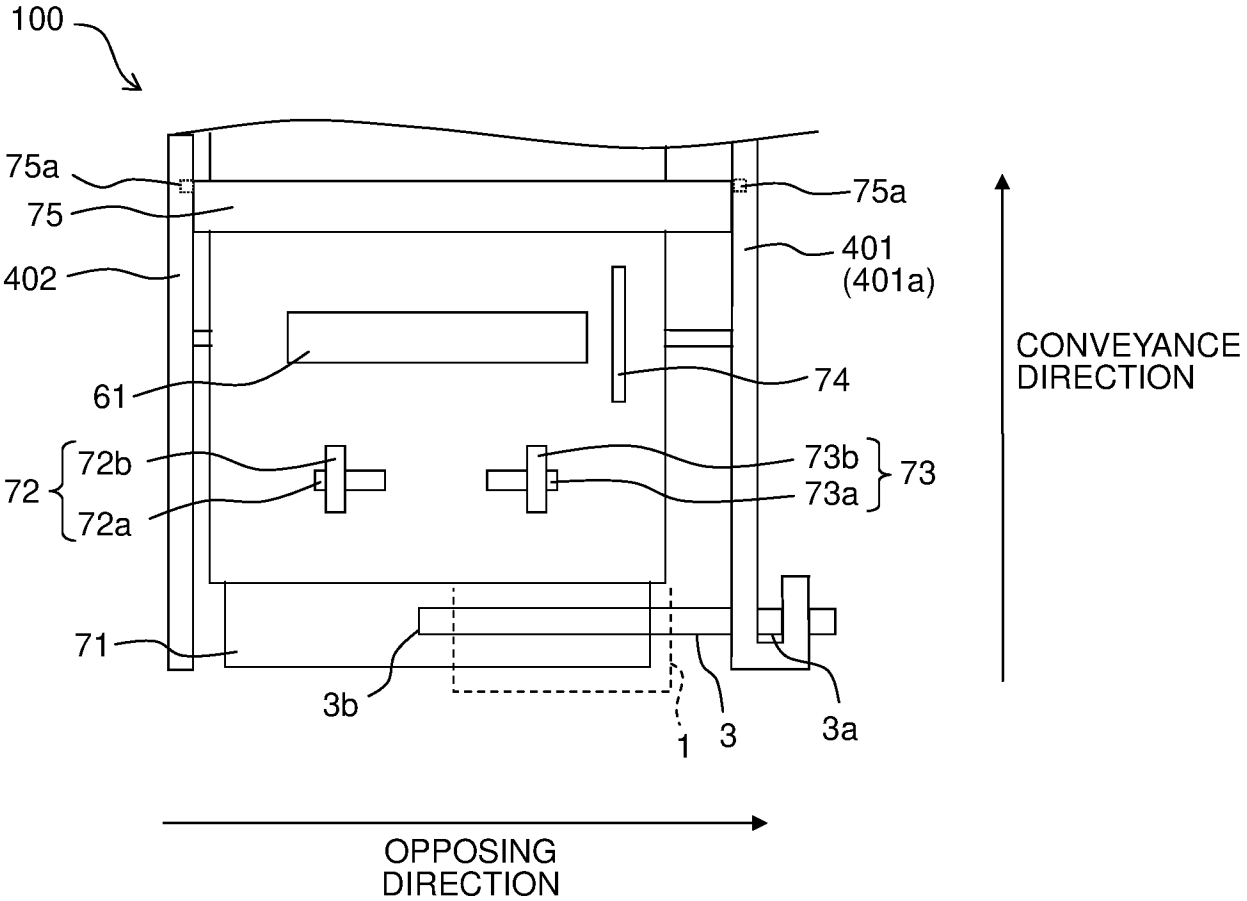
FIG. 5 is a schematic view of the printing apparatus as seen from thereabove, in a state that the cover is opened.

As described above, the first frame 401 is formed with the rising part 401*a* so that the rising part 401 rises from the upper end of the frame 1. As depicted in FIG. 5, the rising part 401*a* has a shape of letter "J" as seen from thereabove. The rising part 401*a* supports the rotational shaft 3 at an end part, of the printing apparatus 100, on a side on which the roll paper holder 5 is provided (on the upstream side in the conveyance direction). In the rotational shaft 3, a first end 3*a* which is a right end as viewed from the conveyance direction is fixed to the rising part 401*a*.

Further, a second end 3*b*, of the rotational shaft 3, which is on an opposite side to the first end 3*a*, is not rotatably supported by the second frame 402. In other words, the second end 3*b* is separated away from the second frame 402.

In the printing apparatus 100, only the first end 3*a* is rotatably supported by the frame, and the second end 3*b* of the rotational shaft 3 is not rotatably supported by the frame and is separated away from the second frame 402. Thus, on a side of the second end 3*b* in the opposing direction, a gap S1 is defined between the second frame 402 and the cover 503 (more particularly, between the second frame 402 and the frame 1) and a gap S2 is defined between the rotational shaft 3 and the second frame 402. As a result, since a forward end of the roll paper 51 can be installed between the conveying roller 61 and the pressing roller 62, via these gaps, it is possible to improve the workability. Further, it is also possible to improve the workability in a case that the rolled paper 51 is removed from the conveying mechanism 6.

As depicted in FIG. 5, the printing apparatus 100 further includes a tensioner 71, a pair of side guides 72 and 73, a rotary encoder disc 74, and a pressing member 75.

The tensioner 71 is provided upstream of the conveying mechanism 6 in the conveyance direction. The tensioner 71 applies a tension to the roll paper 51 which is being conveyed from the roll paper holder 5 to the conveying mechanism 6. The tensioner 71 has a cylindrical shape extending along the opposing direction; a surface, of the tensioner 71, in the circumferential direction has a shape which is curved along the circumferential direction.

The side guides 72 and 73 are provided upstream of the conveying mechanism 6 in the conveyance direction. The side guides 72 and 73 guide an end in the opposing direction of the roll paper 51 so that the roll paper 51 is conveyed in a predetermined direction. In a case that the side guide 72 is viewed from the conveyance direction, the side guide 72 is installed on the left side in the opposing direction with respect to the side guide 73. The side guide 72 and the side guide 73 are installed in positions, respectively, facing each other in the opposing direction.

The side guide 72 includes an opening part 72*a* and a contacting part 72*b*. The opening part 72*a* is an opening provided penetrating through a conveying path, in which the roll paper 51 is conveyed, in the up-down direction. A lower part of the contacting part 72*b* is inserted into the opening part 72*a*, and an upper of the contacting part 72*b* protrudes from the conveying path. The contacting part 72*b* is movable in the opposing direction on the conveyance path by a length in the opposing direction of the opening part 72*a*. The side guide 73 also includes an opening part 73*a* and a contacting part 73*b*, similarly to the side guide 72.

In the printing apparatus 100, before performing printing on the roll paper 51, the position of the contacting part 72*b* of the side guide 72 and the position of the contacting part 73*a* of the side guide 73 are adjusted so that a distance between the contacting part 72*b* of the side guide 72 and the contacting part 73*b* of the side guide 73 becomes the length in the opposing direction of the roll paper 51. With this, in a case that the roll paper 51 is deviated from the predetermined conveyance direction, an end in the opposing direction of the roll paper 51 is brought into contact with the contacting part 72*b* or the contacting part 73*b*, and the direction in which the roll paper 51 is conveyed is corrected. As a result, it is possible to convey the roll paper 51 in the predetermined conveyance direction.

The rotary encoder disc 74 is a member configured to detect a distance by which the roll paper 51 is conveyed on the conveying path. The rotary encoder disc 74 has a disc-shape, and an upper part of the rotary encoder disc 74 is exposed. As depicted in FIG. 5, the rotary encoder disc 74 is arranged between the conveying roller 61 and the first end 3*a* of the rotational shaft 3 in the opposing direction.

As depicted in FIG. 5, the second end 3*b* of the rotational shaft 3 is located between the first end 3*a* and a position of the contact part 72*b* of the side guide 72 in a case that the contact part 72*b* of the side guide 72 is located closest to the side of the first end 3*a*. With this, a large space is formed on a side of the end, in the opposing direction of the rotational shaft 3, which is not rotatably supported on the frame. Consequently, it is possible to improve the workability in a case that the end of the roll paper 51 is inserted between the conveying roller 61 and the pressing roller 62.

Further, in the printing apparatus 100, the end part on the upstream side in the conveyance direction of the side surface 102 of the frame 1 has a shape recessed inwardly. Thus, since it is possible to make the space, in the case that the end of the roll paper 51 is inserted between the conveying roller 61 and the pressing roller 62, to be great, it is possible to improve the workability.

The pressing member 75 is provided between the conveying roller 61 and the conveying belt mechanism 63 in the conveyance direction. The pressing member 75 is a member configured to press the roll paper 51, after the end of the roll paper 51 has been installed between the conveying roller 61 and the pressing roller 62, to thereby hold the roll paper 51 at a desired position. As depicted in FIG. 5, the pressing member 75 rotates, with the rotational shaft 75*a* as the axis. Both ends of the rotational shaft 75 are supported by the first frame 401 and the second frame 402, respectively.

Figure 6:
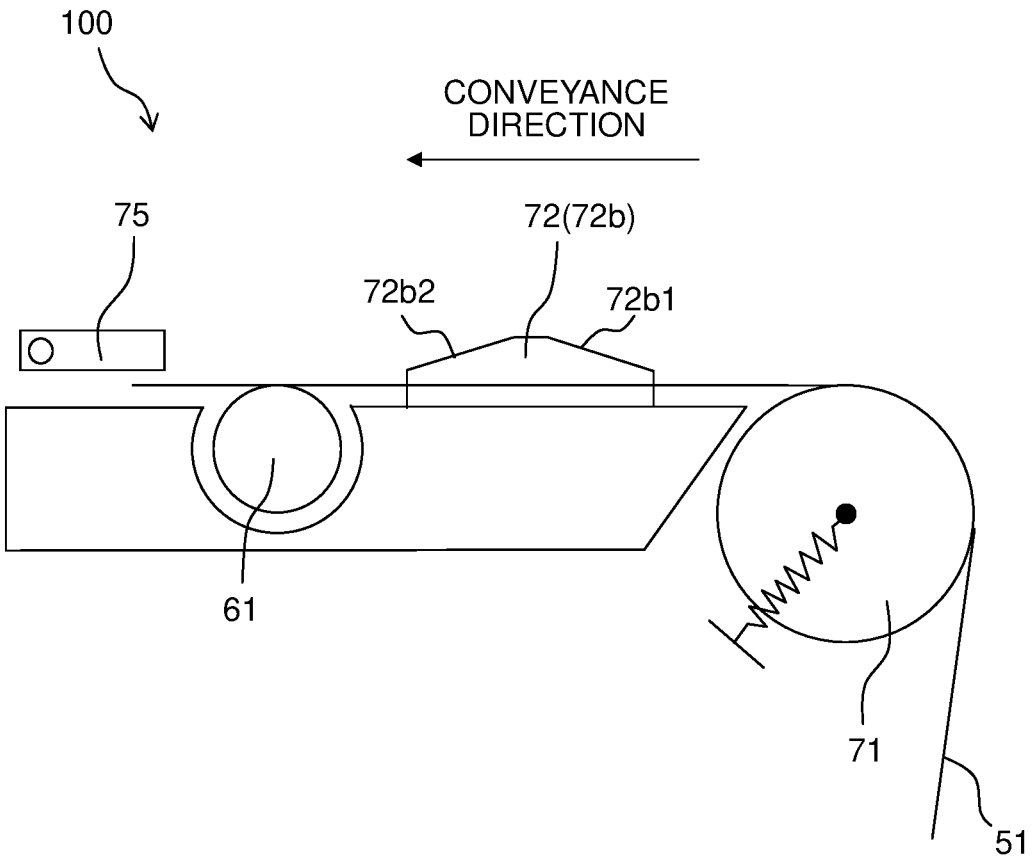
FIG. 6 is a side view of the printing apparatus for explaining the structure of a side guide provided on the printing apparatus.

As depicted in FIG. 6, the contacting part 72*b* includes an upstream part 72*b*1 and a downstream part 72*b*2 in the conveyance direction, and the height of the upstream part 72*b*1 of the contacting part 72*b* becomes lower toward the upstream side in the conveyance direction. With this, it is possible to increase a distance between the side guide 72 and the rotational shaft 3 on the upstream side in the conveyance direction. Consequently, it is possible to improve the workability in a case that the end of the roll paper 51 is inserted between the conveying roller 61 and the pressing roller 62.

Further, in the printing apparatus 100, the rotary encoder disc 74 is arranged, in the opposing direction, between the conveying roller 61 and the first end 3*a* of the rotational shaft 3, as described above. In other words, the rotary encoder disc 74 is not arranged on the left side as viewed from the conveyance direction (namely, on the side of the end, in the opposing direction of the rotational shaft 3, which is not rotatably supported on the frame). Thus, a larger space is formed on the side of the end, in the opposing direction of the rotational shaft 3, which is not rotatably supported on the frame, as compared with the side of the end which is rotatably supported by the frame. Consequently, it is possible to improve the workability in a case that the end of the roll paper 51 is inserted between the conveying roller 61 and the pressing roller 62.

As described above, the printing apparatus 100 is provided with the door 502 and the cover case 600. As depicted in FIG. 1, a recessed part 503*a* which is recessed upward is formed at an upstream-most part in the conveyance direction of the cover case 600 in a case that the cover case 600 is in the closed state.

The door 502 is provided on a side surface on the right side in a case that the printing apparatus 100 is seen from the front surface of the printing apparatus 100. The door 502 is provided with a protruding part 502*a* protruding upward in accordance with the shape of the recessed part 503*a* of the cover case 600. The door 502 is configured to be movable along the conveyance direction. By moving the door 502 toward the upstream side of the conveyance direction, there is provided a state that the inside of the printing apparatus 100 is exposed, thereby making it possible to perform replacement of the roll paper 51, etc.

Second Embodiment

A second embodiment of the present disclosure will be described below. Note that for convenience of explanation, members having the same functions as those of the members described in the first embodiment are denoted by the same reference numerals, and any explanation thereof will not be repeated.

Figure 7:
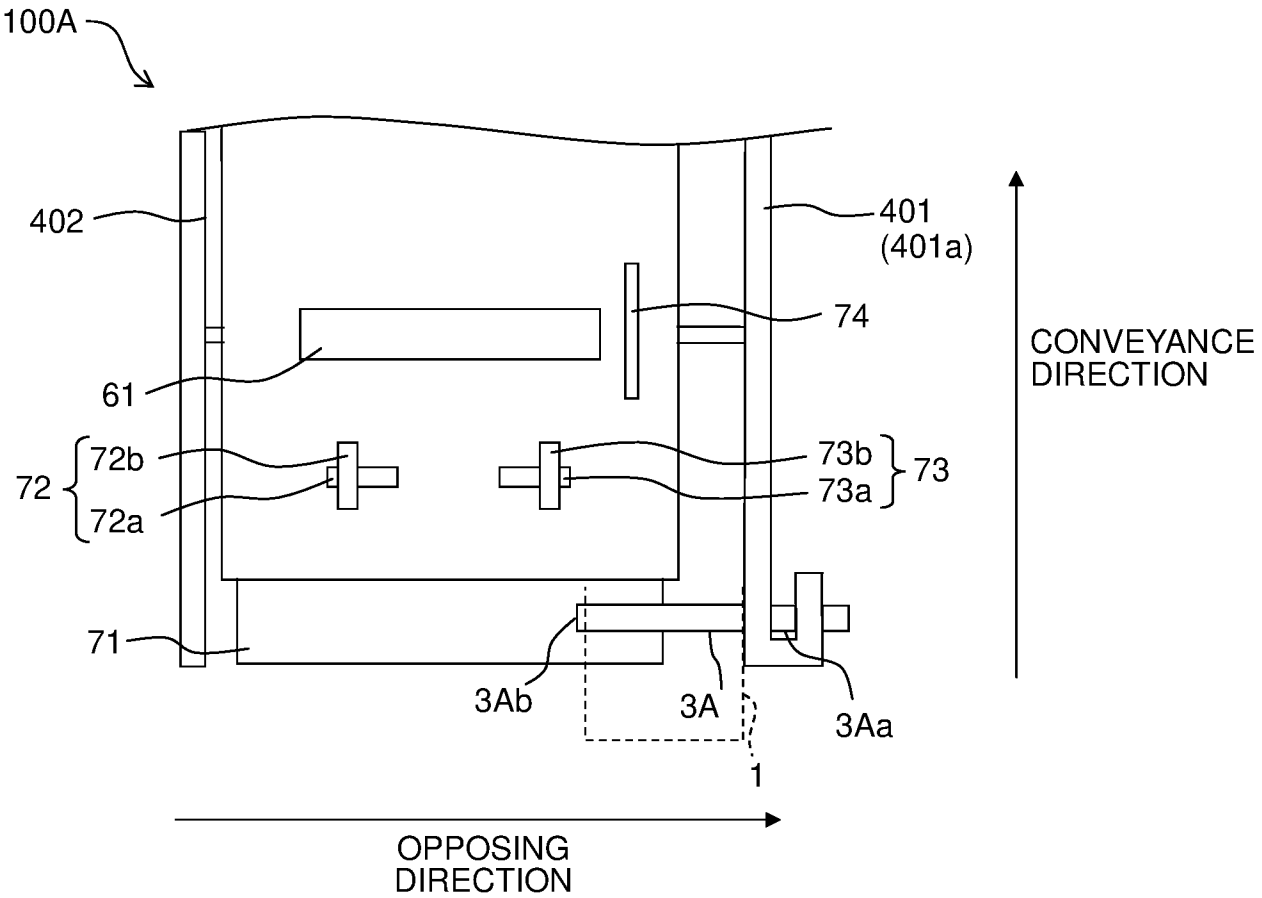
FIG. 7 is a schematic view of a printing apparatus according to a second embodiment of the present disclosure as seen from thereabove, in a state that a cover is opened.

As depicted in FIG. 7, the printing apparatus 100A is provided with a rotational shaft 3A, instead of the rotational shaft 3 in the first embodiment.

In the rotational shaft 3A, a first end 3Aa, which is an end on the right side as viewed from the conveyance direction, is fixed to the rising part 401*a* and is allowed to be a fixed end. On the other hand, a second end 3Ab, in the rotational shaft 3A, which is an end on an opposite side to the first end 3Aa, is not rotatably supported, and is allowed to be a free end.

In the second embodiment, the second end 3Ab of the rotational shaft 3A is located between the first end 3Aa and a position of the contact part 73*b* of the side guide 73 in a case that the contact part 73*b* of the side guide 73 is located closest to the side of the first end 3Aa. Accordingly, a larger space is formed on a side of the end, in the opposing direction of the rotational shaft 3A, which is not rotatably supported on the frame, as compared with the printing apparatus 100 in the first embodiment. Consequently, it is possible to improve the workability in a case that the end of the roll paper 51 is installed between the conveying roller 61 and the pressing roller 62.

Third Embodiment

A third embodiment of the present disclosure will be described below, with reference to FIG. 8. Note that in FIG. 8, the case 501, the door 502 and the cover case 600 are omitted from the illustration.

Figure 8:
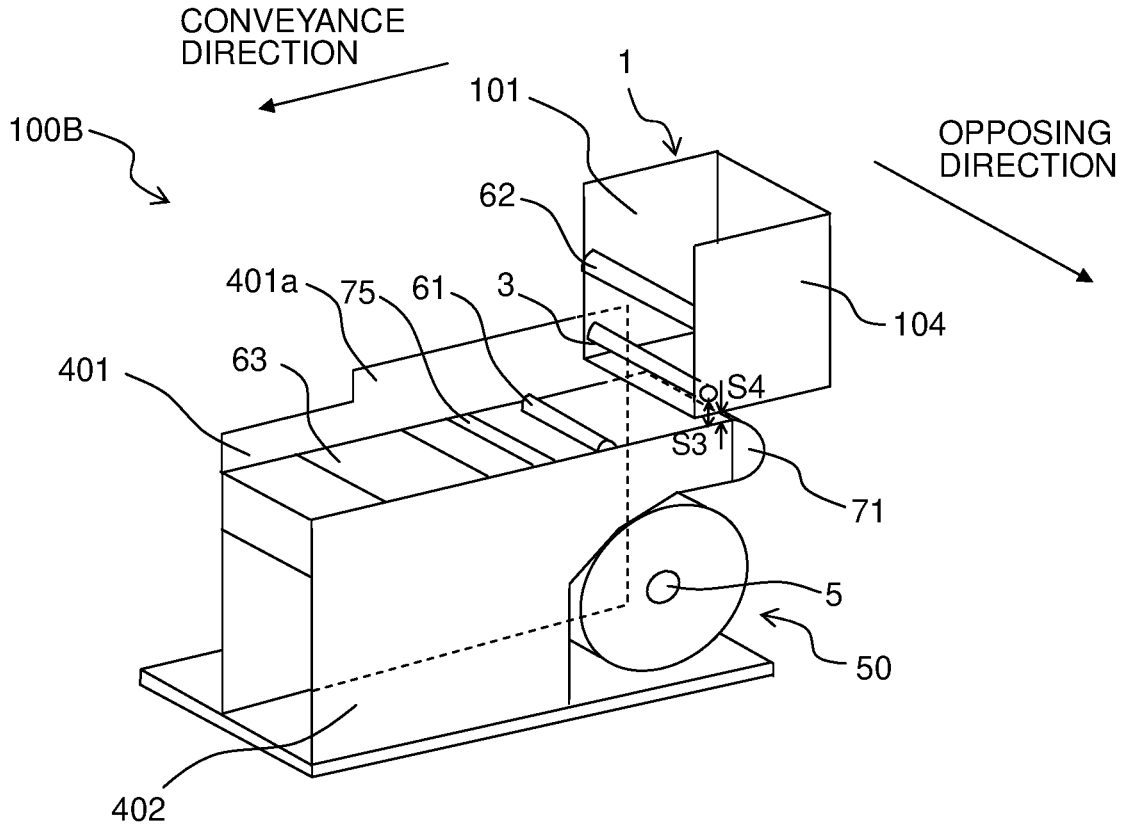
FIG. 8 is a perspective view of a printing apparatus according to a third embodiment of the present disclosure.

As depicted in FIG. 8, a frame 1 of a printing apparatus 100B has a side surface 104, instead of the side surface 102 of the first embodiment. In the printing apparatus 100B, the rotational shaft 3 is fixed to the cover 503 by a side surface 101 and a side surface 104.

Also in the third embodiment, a first end 3*a* of the rotational shaft 3, which is an end on the right side as viewed from the conveyance direction, is fixed to the rising part 401*a* and is allowed to be a fixed end. On the other hand, a second end 3*b*, of the rotational shaft 3, which is an end on the opposite side to the first end is not rotatably supported by the frame, and is separated away from the second frame 402. Thus, on a side of the second end 3*b* in the opposing direction, a gap S3 is formed between the second frame 402 and the cover 503 (more specifically, between the second frame 402 and the frame 1) and a gap S4 is defined between the rotational shaft 3 and the second frame 402. As a result, since a forward end of the roll paper 51 can be installed between the conveying roller 61 and the pressing roller 62, via these gaps, it is possible to improve the workability.

The present disclosure is not limited to each the embodiments described above, and various changes can be made within the scope of the claims; an embodiment which is obtained by appropriately combining the technical means disclosed in different embodiments, respectively, is also included in the technical scope of the present disclosure.

What is claimed is:

1. A printing apparatus comprising:

a sheet storing part configured to store a sheet therein;

a conveying mechanism configured to convey the sheet taken out from the sheet storing part;

a first frame and a second frame arranged in an opposing direction with the conveying mechanism interposed therebetween;

a printing part configured to perform printing on the sheet conveyed by the conveying mechanism;

a cover composing at least a part of an upstream side, of the printing apparatus, with respect to the printing part in a conveyance direction in which the sheet is conveyed by the conveying mechanism; and a rotational shaft extending in the opposing direction and configured to support the cover to be rotatable, wherein the rotational shaft has a first end and a second end in the opposing direction, and the first end is supported by the first frame and the second end is separated away from the second frame.

2. The printing apparatus according to claim 1, wherein the conveying mechanism includes a pair of side guides each configured to guide an end in the opposing direction of the sheet.

3. The printing apparatus according to claim 2, wherein each of the pair of side guides is movable in the opposing direction.

4. The printing apparatus according to claim 3, wherein the pair of side guides includes a first side guide and a second side guide, the first side guide is provided, in the opposing direction, between the second side guide and the first end of the rotational shaft, and the second end of the rotational shaft is located between the first end of the rotational shaft and a position of the first side guide in a case that the first side guide is moved closest to the first end.

5. The printing apparatus according to claim 3, wherein the pair of side guides includes a first side guide and a second side guide, the first side guide is provided, in the opposing direction, between the second side guide and the first end of the rotational shaft, and the second end of the rotational shaft is located between the first end of the rotational shaft and a position of the second side guide in a case that the second side guide is moved closest to the first end.

6. The printing apparatus according to claim 2, wherein the pair of side guides is provided upstream of the conveying mechanism in the conveyance direction.

7. The printing apparatus according to claim 2, wherein each of the pair of side guides is provided with a contacting part configured to make contact with the end in the opposing direction of the sheet, the contacting part includes an upstream part and a downstream part in the conveyance direction; and a height of the upstream part becomes lower toward the upstream side in the conveyance direction.

8. The printing apparatus according to claim 1, wherein the rotational shaft is arranged in a vicinity of the conveying mechanism in a height direction intersecting with the opposing direction and the conveyance direction.

9. The printing apparatus according to claim 1, further comprising a rotary encoder disc configured to detect a distance in which the sheet is conveyed, wherein the rotary encoder disc is arranged between the conveying mechanism and the first end of the rotational shaft in the opposing direction.

* * * * *